US007678036B1

(12) United States Patent
Malitas et al.

(10) Patent No.: US 7,678,036 B1
(45) Date of Patent: Mar. 16, 2010

(54) RIPPLE BOTTOM PIZZA BOX AND ITS ASSOCIATED METHOD OF CONSTRUCTION

(76) Inventors: Eleftherios Malitas, 2215 Berwyn Pl., Philadelphia, PA (US) 19115; Kyriaki Malitas, 2215 Berwyn Pl., Philadelphia, PA (US) 19115

( * ) Notice: Subject to any disclaimer, the term of this patent is extended or adjusted under 35 U.S.C. 154(b) by 151 days.

(21) Appl. No.: 11/825,828

(22) Filed: Jul. 10, 2007

(51) Int. Cl.
*B31B 1/25* (2006.01)

(52) U.S. Cl. ..... 493/59; 493/56; 493/463; 493/966; 229/902; 229/906; 229/939

(58) Field of Classification Search ..... 493/56, 493/59–62, 463, 966; 206/427; 229/902, 229/906, 939
See application file for complete search history.

(56) References Cited

U.S. PATENT DOCUMENTS 3,838,632 A * 10/1974 Miyake ..... 493/276
4,441,626 A 4/1984 Hall ..... 220/443
5,052,559 A * 10/1991 Bressi, Jr. ..... 206/525
5,402,930 A 4/1995 Storms et al. ..... 229/125.2
5,423,477 A 6/1995 Valdman et al. ..... 229/104
5,615,796 A * 4/1997 Rench ..... 229/146

* cited by examiner

*Primary Examiner*—Hemant M Desai
(74) *Attorney, Agent, or Firm*—LaNorte & Associates

(57) ABSTRACT

A ripple bottom pizza box and the method of creating a pizza box with such a ripple bottom. A pizza box blank is provided that is made of corrugated cardboard. The corrugated cardboard has parallel corrugation waves that traverse a flat bottom section pf the pizza box blank in a first direction. A roller is provided that has multiple parallel roller heads. The flat bottom section of the pizza box blank is advanced under the rollers. The parallel roller heads press parallel depressions into the flat bottom section in a direction perpendicular to the first direction of the corrugation waves. The result is that when the pizza box blank is folded into a pizza box, the bottom of the pizza box is contoured with parallel depression lines.

4 Claims, 4 Drawing Sheets

RIPPLE BOTTOM PIZZA BOX AND ITS ASSOCIATED METHOD OF CONSTRUCTION

BACKGROUND OF THE INVENTION

1. Field of the Invention

In general, the present invention relates to cardboard pizza boxes and similar food containers. More particularly, the present invention relates to pizza boxes having a contoured bottom surface that prevents the underside of a pizza from becoming soggy or oily.

2. Prior Art Description

Cardboard boxes specifically designed to hold a round pizza have been in existence for several decades. In this long period of time, numerous different pizza box configurations have been produced. Today, the standard pizza box is a square box that is made from a single folded blank of corrugated cardboard. Once folded, the cardboard forms a box that is about 2 inches high and having equal sides of between 12 inches and 18 inches. The corrugated cardboard used to produce the pizza box is typically thick. This provides the pizza box with structural strength needed to stack multiple filled pizza boxes atop one another without the bottom box collapsing.

In a traditional pizza box, the inside bottom surface of the pizza box is flat and smooth. When a pizza is placed inside the box, the bottom of the pizza lay flush against the flat bottom of the box. Consequently, any condensation or oil that collects between the bottom of the pizza and the bottom of the box becomes trapped. This can cause the bottom of a pizza to become soggy or oily.

In an attempt to prevent a pizza in a box from becoming soggy, inserts have been invented that are placed in between the bottom of a pizza and the bottom of a box. The inserts have ridges that prevent the bottom of the pizza from laying flush on the bottom of the box. Accordingly, any liquid that may collect at the bottom of the box will not touch the pizza. Such prior art pizza box inserts are exemplified by U.S. Pat. No. 4,441,626 to Hall, entitled Pizza Box. Such secondary inserts make the pizza boxes more expensive. As such, pizza box inserts have had little acceptance in the pizza restaurant industry.

To avoid the need for secondary inserts, specialty pizza boxes have been designed that have undulating bottom surfaces. Such pizza boxes are exemplified by U.S. Pat. No. 5,402,930 to Storms, entitled High Quality Inexpensive Pizza Box, and U.S. Pat. No. 5,423,477 to Valdman, entitled Pizza Box. Such prior art pizza boxes have different shapes than do traditional pizza boxes and therefore require different shaped cardboard blanks. Since traditional pizza boxes are made in far greater quantities than are such specialty pizza boxes, the specialty pizza boxes are inevitably more expensive than are traditional pizza boxes.

A need therefore exists for a manner of taking a traditional pizza box and texturing its bottom surface so that air can flow between a bottom of a pizza and the bottom of the box. Furthermore, the texturing must be accomplished without adding material to the box and without otherwise increasing the cost of the box. This need is met by the present invention as described and claimed below.

SUMMARY OF THE INVENTION

The present invention is a pizza box having a rippled inside bottom surface and the method of creating a pizza box with such a rippled inside bottom surface. A pizza box blank is provided that is made of corrugated cardboard. The corrugated cardboard has parallel corrugation waves that traverse a flat bottom section pf the pizza box blank in a first direction.

A roller is provided that has multiple parallel roller heads. The flat bottom section of the pizza box blank is advanced under the rollers. The parallel roller heads press parallel depressions into the flat bottom section in a direction perpendicular to the first direction of the corrugation waves. The result is that when the pizza box blank is folded into a pizza box, the inside bottom of the pizza box is contoured with parallel depression lines. As a result, air I permitted to flow under any pizza that is placed in the pizza box. This prevents the pizza from becoming soggy or oily without requiring the used of expensive after market inserts.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
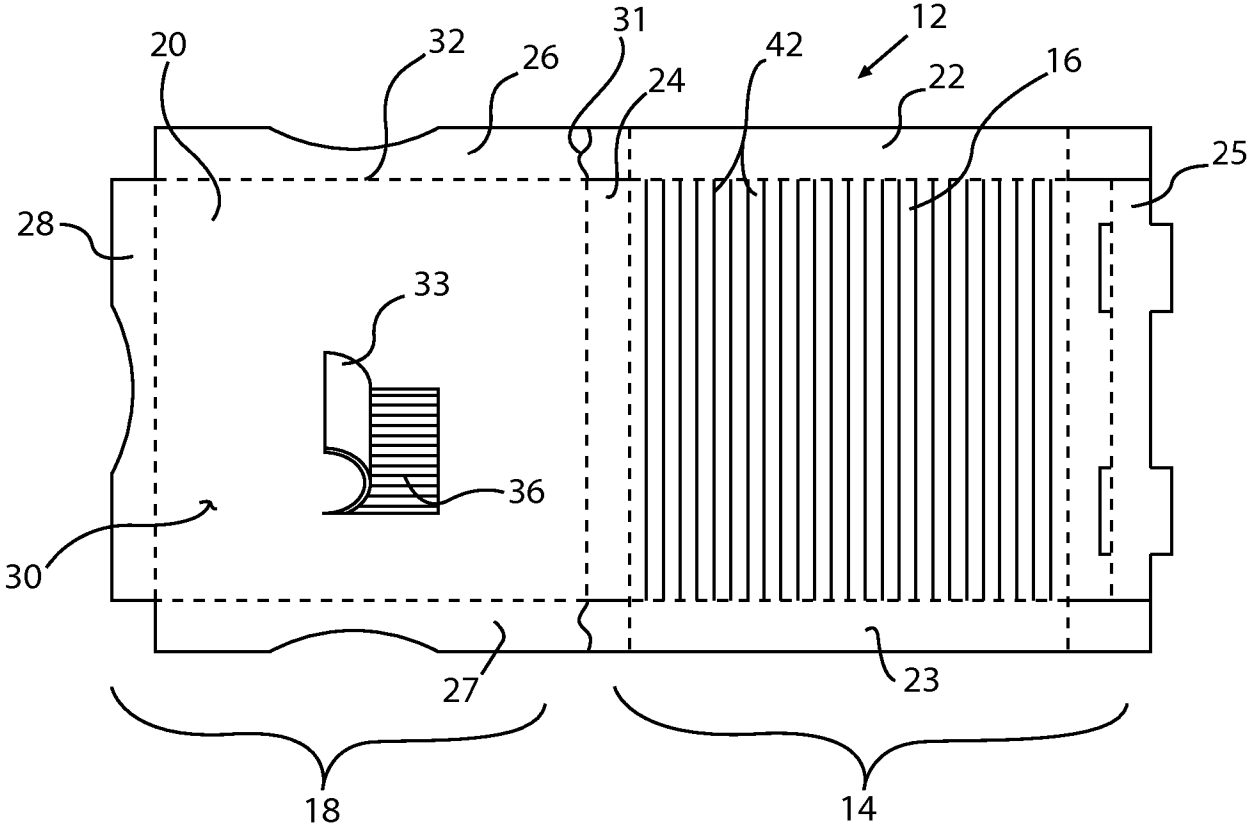
FIG. 1 is a top view of an exemplary embodiment of a pizza box blank.
Figure 2:
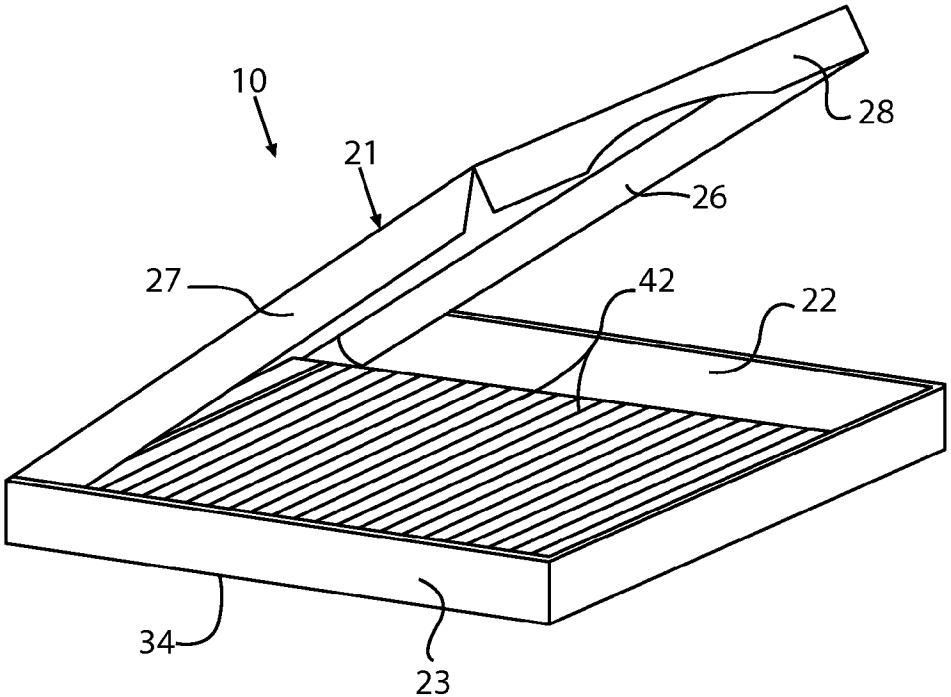
FIG. 2 is a perspective view of a pizza box folded from the blank shown in FIG. 1.

Referring to FIG. 1 in conjunction with FIG. 2, there is shown a cardboard blank 12 for a ripple bottom pizza box 10. The cardboard blank 12 has a lower section 14 and an upper section 18 that interconnect. The lower section 14 of the cardboard blank 12 contains a large flat bottom square 16 that will serve as the bottom surface of the pizza box 10. The upper section 18 has a similarly large flat top square 20 that will serve as the roof of the pizza box lid 21.

The lower section 14 of the cardboard blank 12 has side tabs 22, 23 and end tabs 24, 25 that form the four sides of the pizza box 10 around the periphery of the flat bottom square 16. Similarly, the upper section 18 has side tabs 26, 27 and end tab 28 that forms the sides of the pizza box lid 21. A plurality of cut lines 31 and perforated lines 32 are formed in the cardboard blank 12 to facilitate the folding of the cardboard blank 12 into the shape of the ripple bottom pizza box 10.

In the shown embodiment, the cardboard blank 12 is made of three-ply corrugated cardboard 30. That is, the cardboard 30 has a smooth top layer 33, a smooth bottom layer 34 and a corrugated layer 36 interposed between the top layer 33 and the bottom layer 34. The corrugated layer 36 produces parallel corrugation waves 40. The parallel corrugation waves 40 are oriented so that they extend the length of the cardboard blank 12. This places the corrugation waves 40 parallel to the sides of the flat bottom square 16 and perpendicular to the front and rear of the flat bottom square 16.

Figure 3:
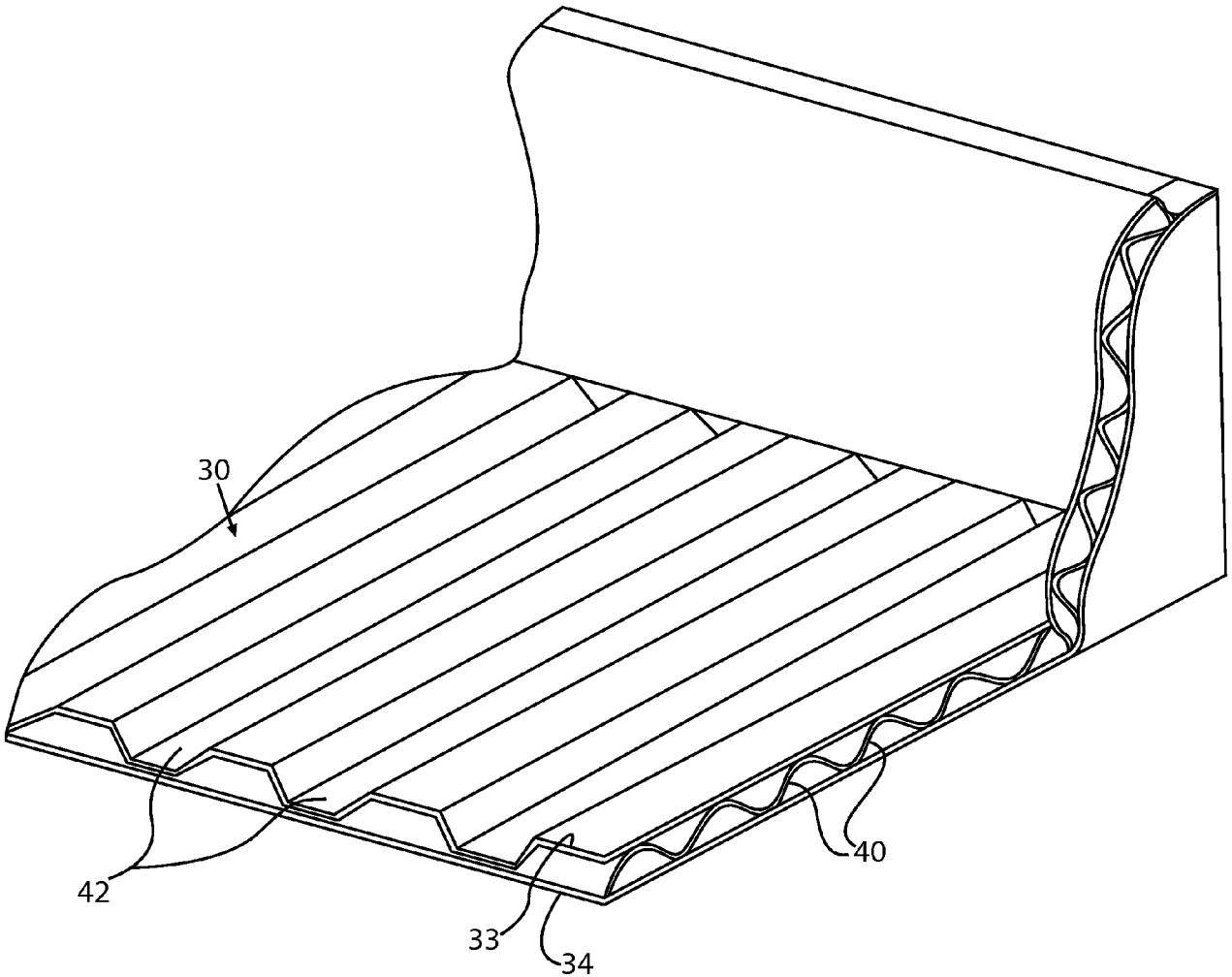
FIG. 3 is a cross-sectional view of a portion of the pizza box shown in FIG. 2.

Referring to FIG. 3 in conjunction with FIG. 1 and FIG. 2, it can be seen that depression lines 42 are pressed into the flat bottom square 16 of the cardboard blank 12. The depressions lines 42 can be between ⅛ inch and 1 inch wide and can be spaced between ⅛ inch and one inch apart. In a preferred embodiment, the depression lines 42 are ½ inch wide and are spaced ½ inch apart. The depression lines 42 are formed at a perpendicular to the direction of the corrugation waves 40 in the corrugated layer 36. The depression lines 42 are created by pressing the corrugation waves 40 flat in between the top layer 33 and the bottom layer 34 of the corrugated cardboard 30. A compression rate of up to 80% can be achieved by mechanical pressing. This causes the depression lines 42 to have a depth equal to between 10% and 20% of the total thickness of the corrugated cardboard 30.

Figure 4:
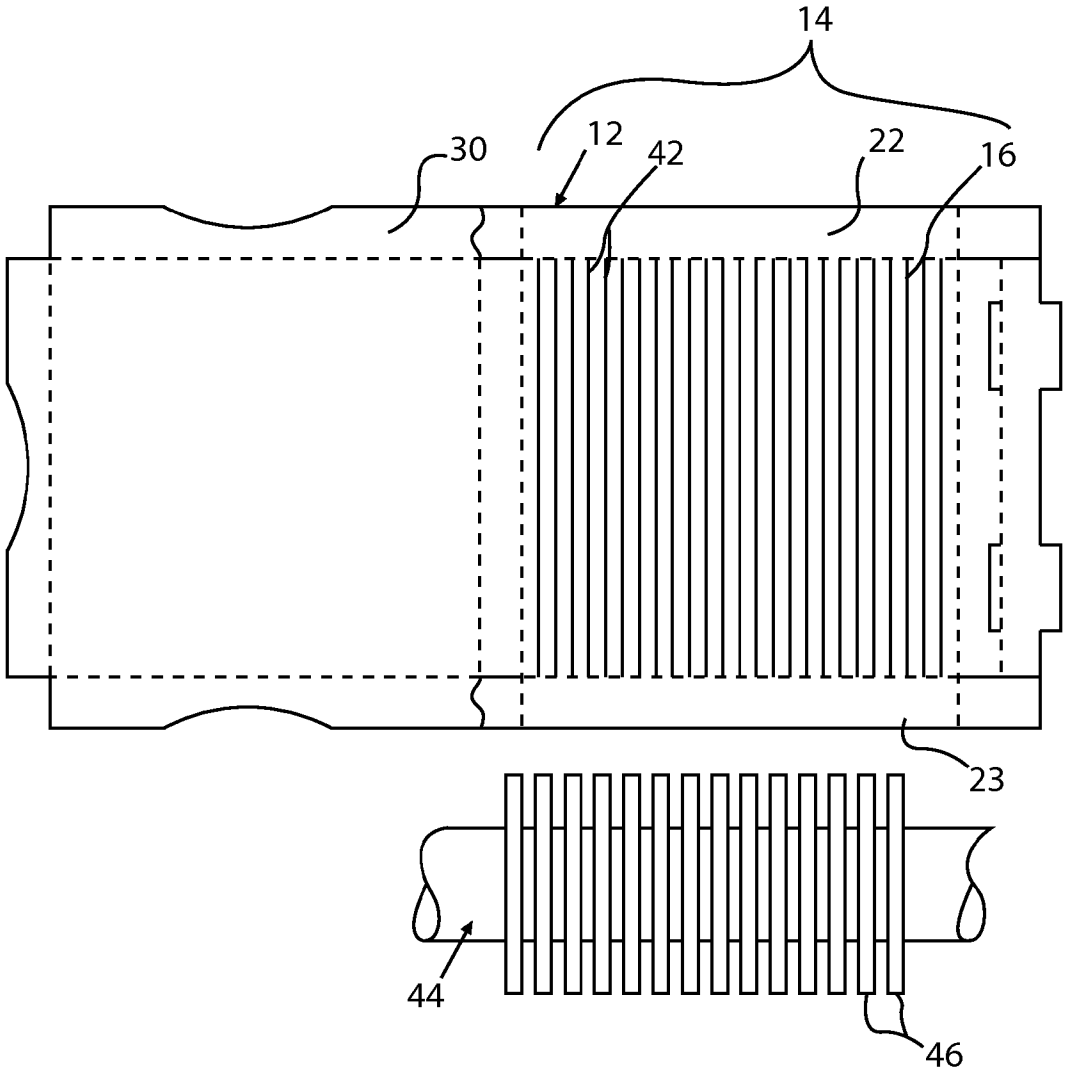
FIG. 4 shows a method of forming depression lines in a section of the pizza box blank of FIG. 1

Referring to FIG. 4, it can be seen that to make the present invention pizza box, cardboard 30 is cut into the shape of a traditional pizza box blank 12. Prior to the pizza box blanks 12 being stacked and packaged, they are sent under a roller 44. The roller 44 has a plurality of roller heads 46 that extend in parallel planes along a common axis. The roller heads 46 compress the cardboard 30 in lines across the lower section 14 of the pizza box blank 12. This creates depressions lines 42 across the flat bottom square 16 of the ripple bottom pizza box 10.

The roller heads 46 roll across the corrugation waves 40 in a perpendicular direction. This prevents the roller heads 46 from tearing the top layer 33 (FIG. 3) of the corrugated cardboard 30, as would happen if a parallel path were rolled. The roller 44 can be dropped and lifted so that it creates depression lines 42 in the flat bottom square 16. Additionally, the roller 44 can be stationary so that it creates depression lines 42 not only in the flat bottom square 16 of the blank 12, but also on the side panel tabs 22, 23. The depression lines 42 on the side panel tabs 22, 23 serve no purpose and do not adversely affect the structure of the overall ripple bottom pizza box 10.

A roller 44 capable of creating depression lines 42 in the corrugated cardboard 30 of a pizza box 10 can be obtained for only a few hundred dollars. This cost amortized over many thousands of pizza boxes, is negligible and will not affect the cost of the pizza box. The present invention ripple bottom pizza box 10 with depression lines 42 on its flat bottom square 16 can, therefore, be manufactured and sold for the exact same price as are standard pizza boxes.

It will be understood that the embodiment of the present invention that is illustrated and described is merely exemplary and that a person skilled in the art can make many variations to that exemplary embodiment while still adhering to the spirit of the invention. For instance, there are many different cardboard blanks in existence that are used to form pizza boxes. Any such blank, provided it is made from three ply cardboard, can be adapted for use by the present invention. It will therefore be understood that the end product pizza box can vary in shape and size and still be in accordance with the present invention. All such variations, modifications and alternate embodiments are intended to be included within the scope of the present invention as described and claimed below.

What is claimed is:

1. In a pizza box blank made of corrugated cardboard and having a flat bottom section, wherein said corrugated cardboard has parallel corrugation waves, disposed between a top layer and a bottom layer, that traverse said flat bottom section in a first direction, a method of forming depressions in said flat bottom section, comprising the steps of:

providing a roller having multiple parallel roller heads; and advancing said flat bottom section of said pizza box blank under said roller, wherein said parallel roller heads compress said corrugation waves flat between said top layer and said bottom layer, therein producing parallel depressions in said flat bottom section of said pizza box blank in a direction perpendicular to said first direction of said corrugation waves.

2. The method of claim 1, wherein each of said parallel roller heads creates a depression in said flat bottom section that is between ⅛ inch and 1 inch wide.

3. The method of claim 1, wherein each of said parallel roller heads are spaced between ⅛ inch and one inch apart.

4. The method according to claim 1, wherein said flat bottom section of said pizza box blank has two side edges that are perpendicular to said first direction of said corrugation waves, wherein said step of advancing said flat bottom section of said pizza box blank under said roller creates continuous parallel depressions between said two side edges.

* * * * *